US010815040B2

(12) United States Patent
Hsu

(10) Patent No.: US 10,815,040 B2
(45) Date of Patent: Oct. 27, 2020

(54) ANTITHEFT DISPLAY PACK FOR HAND TOOL

(71) Applicant: Huang-Tung Hsu, Taichung (TW)

(72) Inventor: Huang-Tung Hsu, Taichung (TW)

( * ) Notice: Subject to any disclaimer, the term of this patent is extended or adjusted under 35 U.S.C. 154(b) by 114 days.

(21) Appl. No.: 16/357,370

(22) Filed: Mar. 19, 2019

(65) Prior Publication Data

US 2020/0299045 A1 Sep. 24, 2020

(51) Int. Cl.
*B65D 73/00* (2006.01)
*B25H 3/00* (2006.01)

(52) U.S. Cl.
CPC ..... *B65D 73/0064* (2013.01); *B25H 3/003* (2013.01); *B65D 2211/00* (2013.01)

(58) Field of Classification Search
CPC .. A47F 5/00; A47F 5/0006; A47F 5/08; A47F 5/0823; B23B 51/04; B25H 3/00; B25H 3/003; B65D 73/00; B65D 73/0064; B65D 85/00; B65D 2211/00
USPC ..... 206/349
See application file for complete search history.

(56) References Cited

U.S. PATENT DOCUMENTS 5,740,911 A * 4/1998 Chou ..... B65D 73/0064 206/378
5,862,913 A * 1/1999 Chou ..... A47F 5/0823 206/378
7,264,213 B2 * 9/2007 Liu ..... A47F 5/0006 206/378
8,443,972 B1 * 5/2013 Pendergraph ..... B65D 85/00 206/349
8,919,552 B2 * 12/2014 Pendergraph ..... B65D 85/00 206/349

* cited by examiner

*Primary Examiner* — Bryon P Gehman
(74) *Attorney, Agent, or Firm* — Alan D. Kamrath; Mayer & Williams PC

(57) ABSTRACT

An antitheft display pack includes a hanging member, a fastening member, and a hand tool. The hanging member includes a main body and a support portion. The support portion has a mounting chamber, at least one locking hole and a stop column. The fastening member includes a first limit portion and a second limit portion. The first limit portion is mounted in the mounting chamber, and has at least one locking hook locked in the at least one locking hole. The fastening member has a receiving hole for receiving the stop column. The second limit portion is provided with a locking block. The hand tool is mounted on the fastening member and has a plurality of retaining grooves, and the locking block is locked in one of the retaining grooves.

5 Claims, 11 Drawing Sheets

ANTITHEFT DISPLAY PACK FOR HAND TOOL

BACKGROUND OF THE INVENTION

1. Field of the Invention

The present invention relates to an antitheft device and, more particularly, to an antitheft display pack for a hand tool that is displayed or exhibited in a store or a mall.

2. Description of the Related Art

A conventional tool display pack comprises a hanging member provided with a hanging hole, and a hand tool mounted on the hanging member. Thus, the hanging hole of the hanging member is hung on an exhibition rack to attract the consumer's attention, and to facilitate the consumer selecting and purchasing the hand tool. However, the hand tool is easily removed from the hanging member, such that the conventional tool display pack does not provide any burglarproof function during exhibition of the hand tool.

BRIEF SUMMARY OF THE INVENTION

The primary objective of the present invention is to provide an antitheft display pack that provides a burglarproof function during exhibition of a hand tool, such as a socket and the like.

In accordance with the present invention, there is provided an antitheft display pack comprising a hanging member, a fastening member mounted on the hanging member, and a hand tool mounted on the fastening member. The hanging member includes a main body and a support portion. The main body of the hanging member is provided with a hanging hole. The support portion of the hanging member has an interior provided with a mounting chamber. The support portion of the hanging member has a side provided with at least one locking hole connected to the mounting chamber. The support portion of the hanging member is provided with a stop column disposed in the mounting chamber. The fastening member includes a first limit portion and a second limit portion. The first limit portion of the fastening member is mounted in the mounting chamber of the hanging member. The first limit portion of the fastening member is provided with at least one locking hook locked in the at least one locking hole of the hanging member. The fastening member is provided with a receiving hole, and the stop column of the hanging member is mounted in the receiving hole of the fastening member. The second limit portion of the fastening member has a side provided with a locking block. The hand tool is provided with a slot mounted on the second limit portion of the fastening member. The slot of the hand tool has a periphery provided with a plurality of retaining grooves, and the locking block of the fastening member is locked in one of the retaining grooves of the hand tool.

According to the primary advantage of the present invention, the locking block of the fastening member is stopped by the stop column of the hanging member, and is positioned in one of the retaining grooves of the hand tool, such that the hand tool cannot be removed from the fastening member by an external force, thereby achieving an antitheft function.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
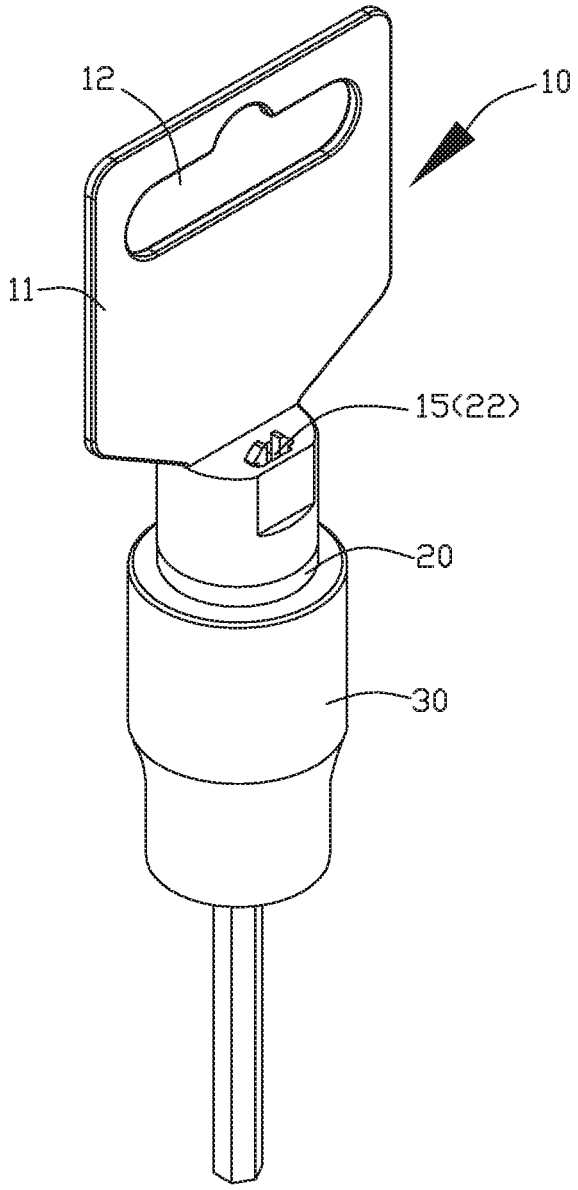
FIG. 1 is a perspective view of an antitheft display pack in accordance with the preferred embodiment of the present invention.
Figure 2:
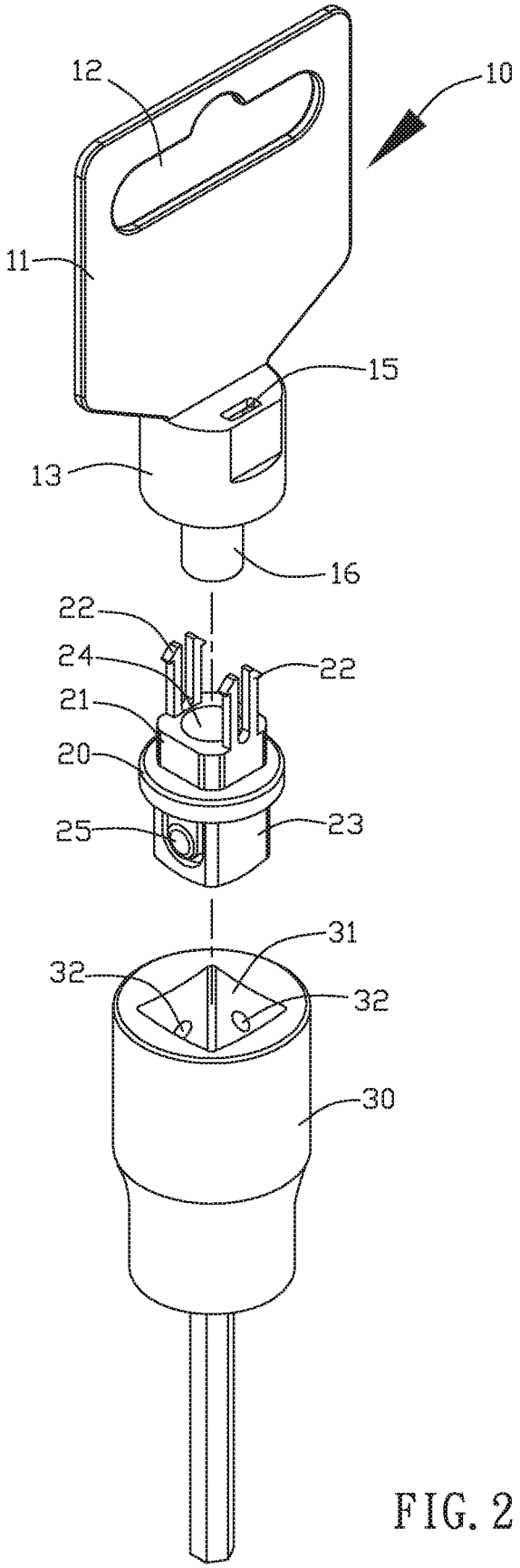
FIG. 2 is an exploded perspective view of the antitheft display pack in accordance with the preferred embodiment of the present invention.
Figure 3:
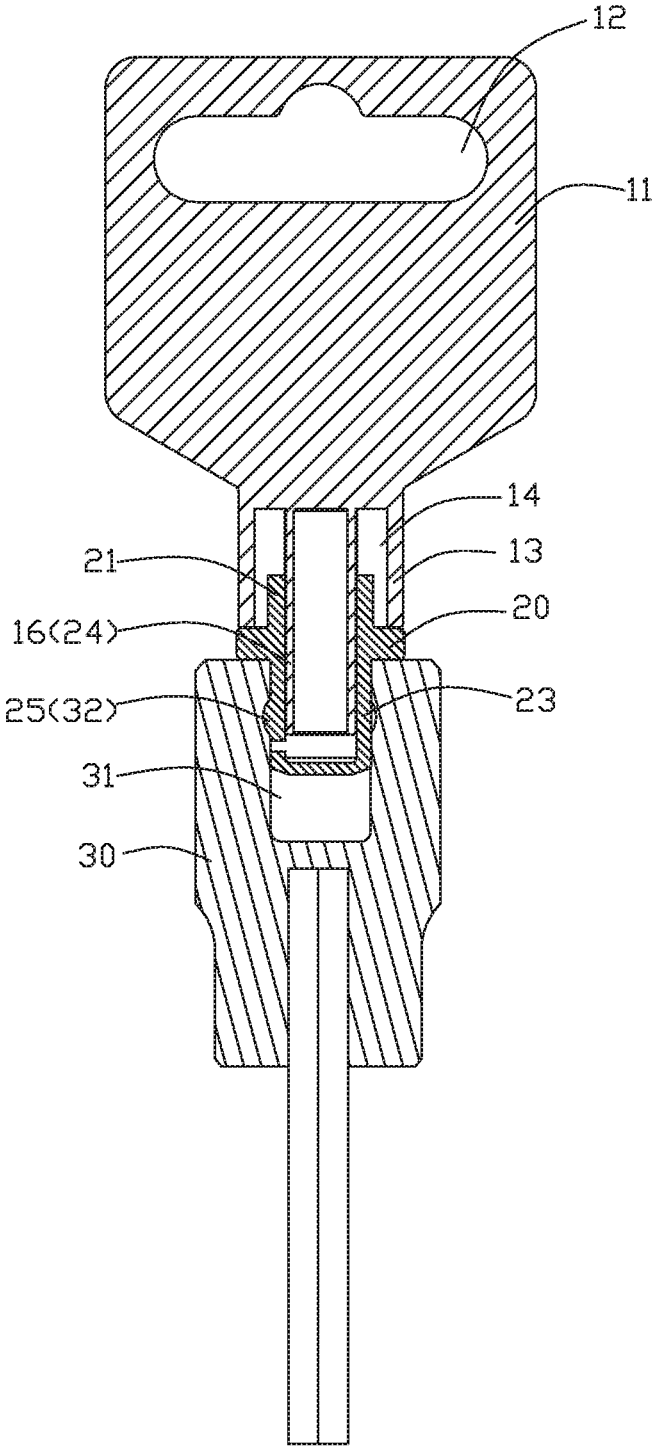
FIG. 3 is a front cross-sectional view of the antitheft display pack in accordance with the preferred embodiment of the present invention.
Figure 4:
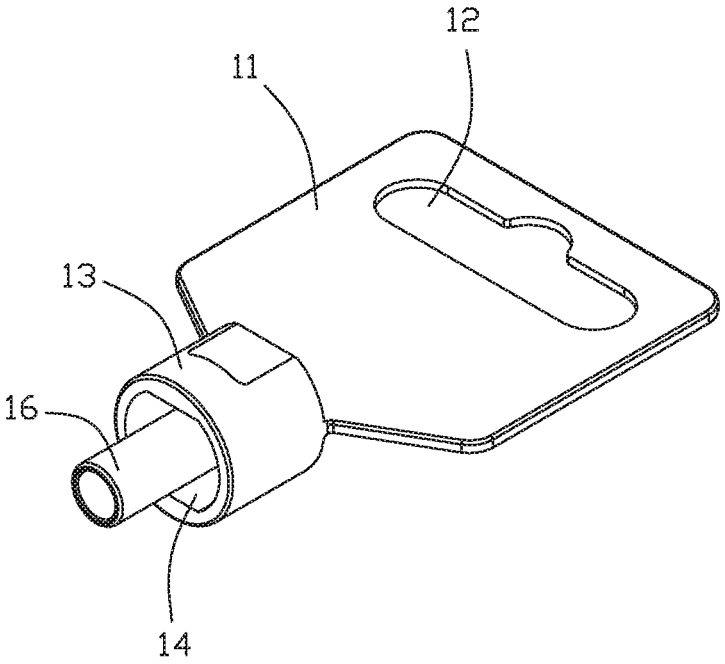
FIG. 4 is a perspective view of a hanging member of the antitheft display pack in accordance with the preferred embodiment of the present invention.
Figure 5:
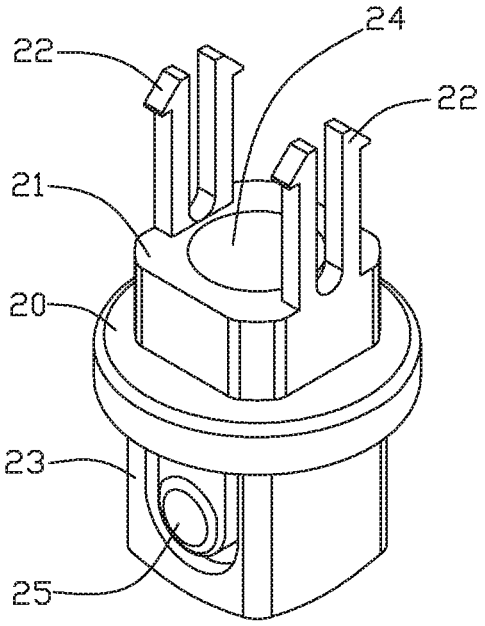
FIG. 5 is a perspective view of a fastening member of the antitheft display pack in accordance with the preferred embodiment of the present invention.
Figure 6:
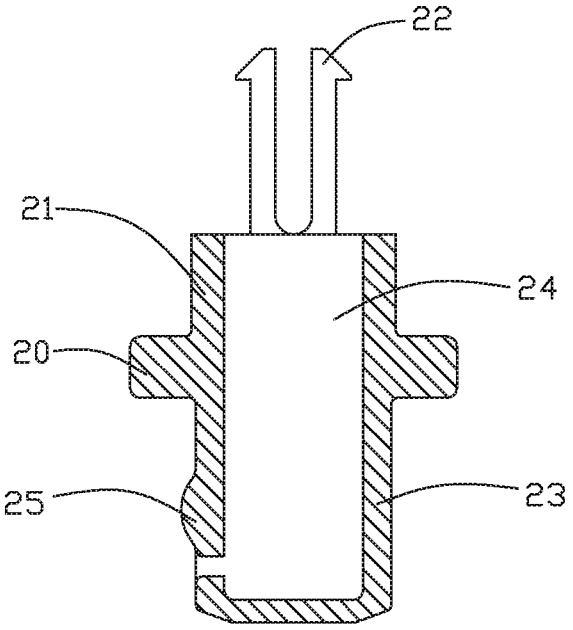
FIG. 6 is a front cross-sectional view of the fastening member of the antitheft display pack in accordance with the preferred embodiment of the present invention.
Figure 7:
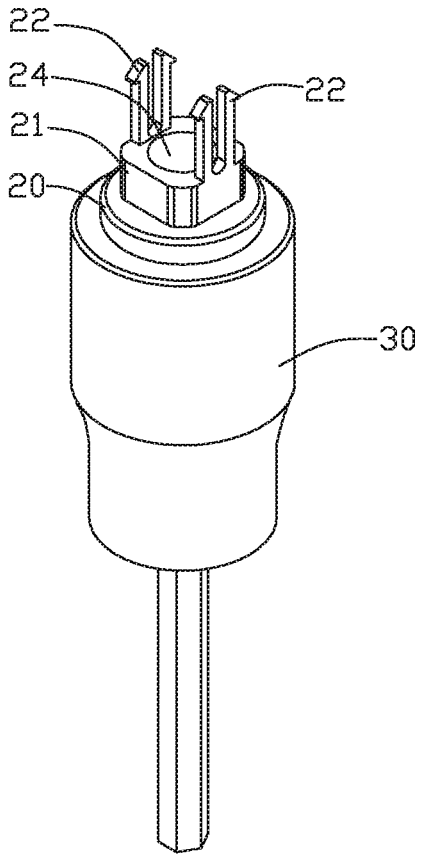
FIG. 7 is a perspective view showing combination of the fastening member and the hand tool of the antitheft display pack in accordance with the preferred embodiment of the present invention.

Referring to the drawings and initially to FIGS. 1-7, an antitheft display pack (or security pack or display packaging or tool hanger or stop lock or hanging lock) in accordance with the preferred embodiment of the present invention comprises a hanging member 10, a fastening (or connecting or locking or securing or restricting) member 20 mounted on the hanging member 10, and a hand tool 30 mounted on the fastening member 20.

The hanging member 10 includes a main body 11 and a support portion (or hanging portion) 13. The main body 11 of the hanging member 10 is provided with a hanging hole 12. The support portion 13 of the hanging member 10 has an interior provided with a mounting chamber 14. The support portion 13 of the hanging member 10 has a side provided with at least one locking hole 15 connected to the mounting chamber 14. The support portion 13 of the hanging member 10 is provided with a stop column 16 disposed in the mounting chamber 14.

The fastening member 20 includes a first limit portion 21 and a second limit portion 23. The first limit portion 21 of the fastening member 20 is mounted in the mounting chamber 14 of the hanging member 10. The first limit portion 21 of the fastening member 20 is provided with at least one locking hook 22 locked in the at least one locking hole 15 of the hanging member 10. The fastening member 20 is provided with a receiving hole 24, and the stop column 16 of the hanging member 10 is mounted in the receiving hole 24 of the fastening member 20. The second limit portion 23 of the fastening member 20 has a side provided with a locking block 25 abutting the stop column 16 of the hanging member 10.

The hand tool 30 is provided with a slot 31 mounted on the second limit portion 23 of the fastening member 20. The slot 31 of the hand tool 30 has a periphery provided with a plurality of retaining grooves 32, and the locking block 25 of the fastening member 20 is locked in one of the retaining grooves 32 of the hand tool 30.

In the preferred embodiment of the present invention, the mounting chamber 14 of the hanging member 10 has an inner diameter with a non-circular shape, and the first limit portion 21 of the fastening member 20 has a non-circular shape corresponding to that of the mounting chamber 14, such that the first limit portion 21 of the fastening member 20 is located in the mounting chamber 14 of the hanging member 10, and is non-rotatable relative to the support portion 13 of the hanging member 10.

In the preferred embodiment of the present invention, the at least one locking hole 15 of the hanging member 10 has a number more than two, and the at least one locking hook 22 of the fastening member 20 has a number equal to that of the at least one locking hole 15.

In the preferred embodiment of the present invention, the stop column 16 of the hanging member 10 has an outer diameter slightly smaller than an inner diameter of the receiving hole 24 of the fastening member 20.

In the preferred embodiment of the present invention, the locking block 25 of the fastening member 20 has a top connected with the second limit portion 23 of the fastening member 20 and has a periphery separated from the second limit portion 23 of the fastening member 20, such that the locking block 25 of the fastening member 20 is movable relative to the second limit portion 23 of the fastening member 20 when being subjected to a force.

In the preferred embodiment of the present invention, the support portion 13 of the hanging member 10 is formed integrally with the bottom of the main body 11. The fastening member 20 has a top formed integrally with the first limit portion 21 and a bottom formed integrally with the second limit portion 23. The receiving hole 24 in turn extends through the first limit portion 21, the fastening member 20 and the second limit portion 23. The slot 31 of the hand tool 30 has a shape corresponding to that of the second limit portion 23 of the fastening member 20.

In assembly, when the slot 31 of the hand tool 30 is mounted on the second limit portion 23 of the fastening member 20, the locking block 25 of the fastening member 20 is locked in one of the retaining grooves 32 of the hand tool 30. Then, the first limit portion 21 of the fastening member 20 is inserted into the mounting chamber 14 of the hanging member 10, and the at least one locking hook 22 of the fastening member 20 extends through the mounting chamber 14 of the hanging member 10, and is locked in the at least one locking hole 15 of the hanging member 10. Thus, the hanging member 10, the fastening member 20, and the hand tool 30 are connected together.

Figure 8:
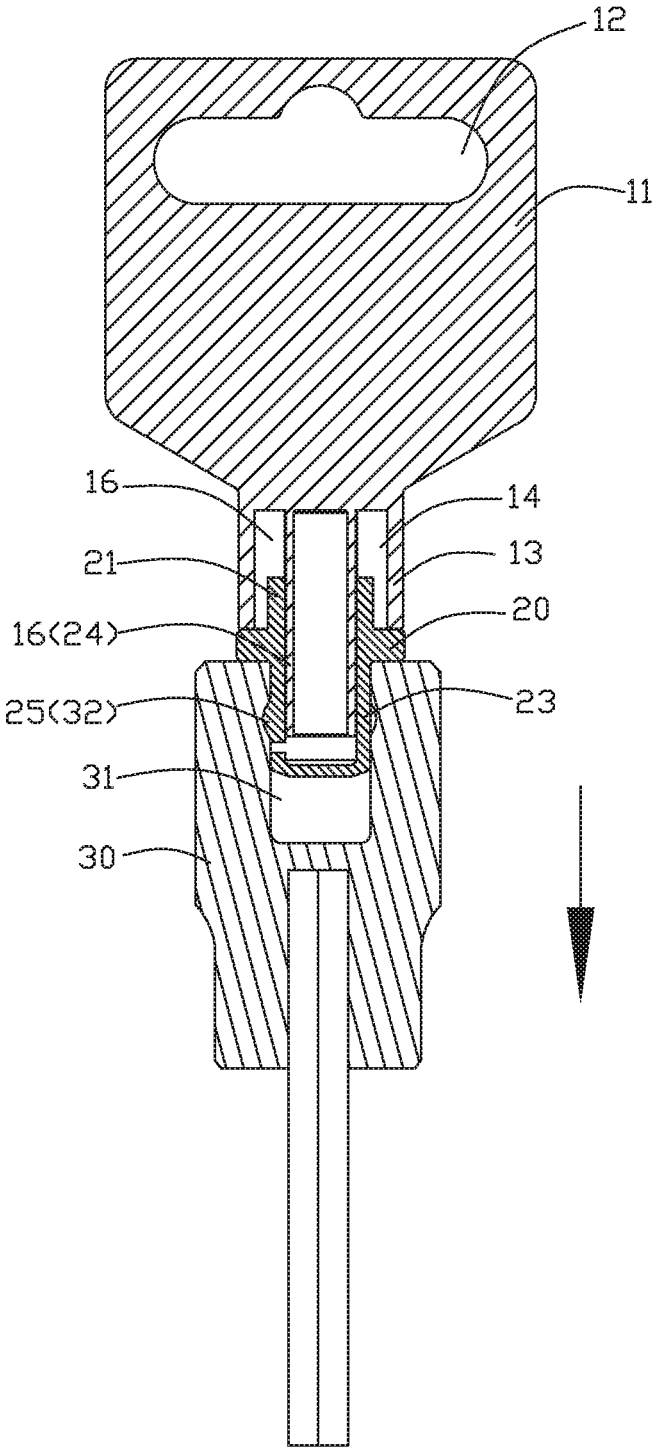
FIG. 8 is a schematic operational view of the antitheft display pack as shown in FIG. 3.
Figure 9:
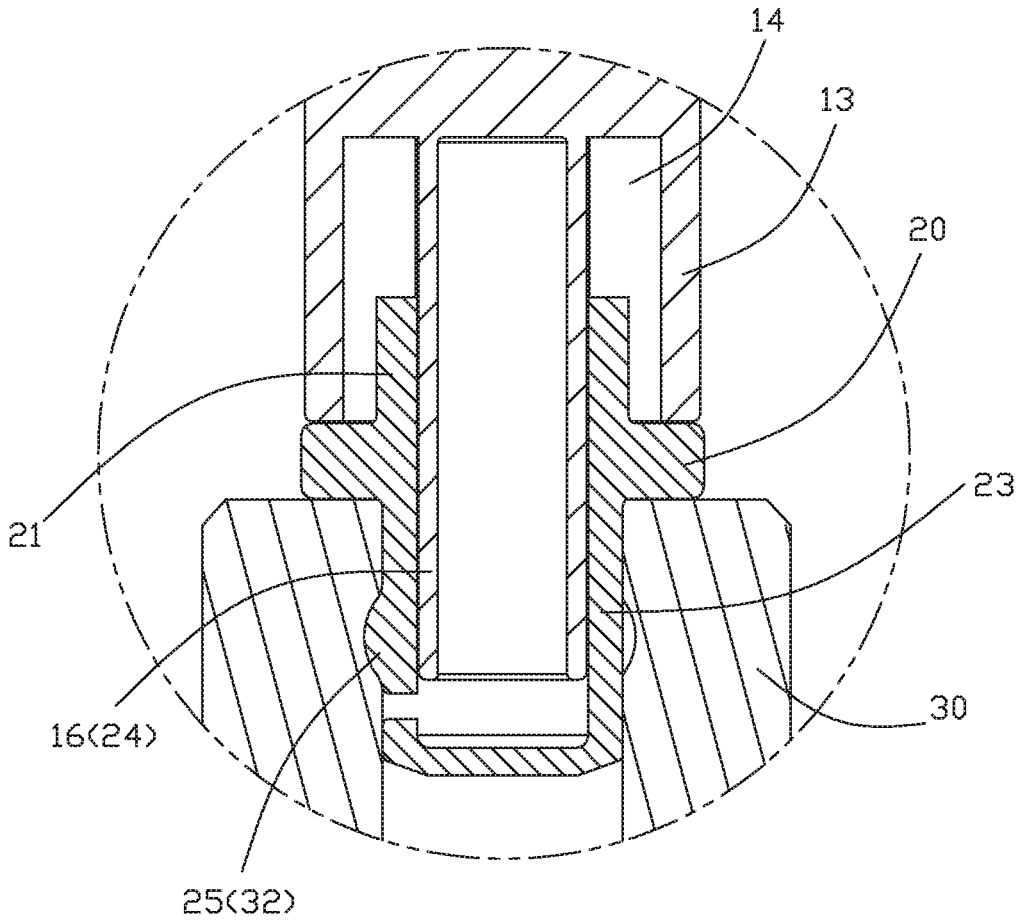
FIG. 9 is a locally enlarged view of the antitheft display pack as shown in FIG. 8.

In practice, referring to FIGS. 8 and 9 with reference to FIGS. 1-7, the hanging hole 12 of the hanging member 10 is hung on an exhibition rack to attract the consumer's attention. At this time, the locking block 25 of the fastening member 20 is limited and stopped by the stop column 16 of the hanging member 10, such that the locking block 25 of the fastening member 20 is located and cannot be displaced any more. Thus, the locking block 25 of the fastening member 20 is exactly locked in and cannot be released from one of the retaining grooves 32 of the hand tool 30, such that the hand tool 30 is secured to the fastening member 20 solidly. In such a manner, when someone wishes to pull down the hand tool 30 as shown in FIG. 8, the locking block 25 of the fastening member 20 is stopped by the stop column 16 of the hanging member 10, and is positioned in one of the retaining grooves 32 of the hand tool 30 as shown in FIG. 9, such that the hand tool 30 is combined with and is not detached from the fastening member 20. Thus, the hand tool 30 cannot be removed from the fastening member 20 by an external force, thereby achieving an antitheft function.

Figure 10:
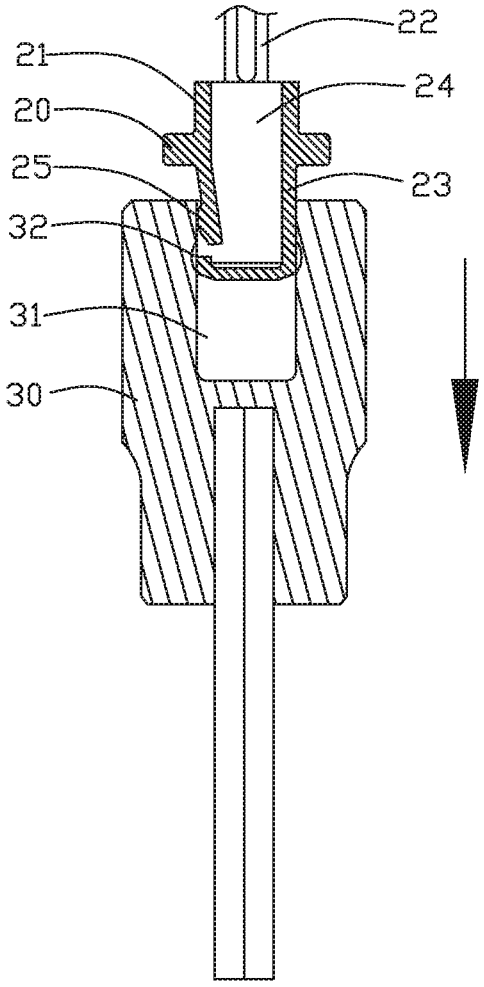
FIG. 10 is a schematic operational view of the antitheft display pack as shown in FIG. 3.

Referring now to FIG. 10 with reference to FIGS. 1-7, when the antitheft display pack is taken home, the at least one locking hook 22 of the fastening member 20 is cut by the user, and unlocked from the at least one locking hole 15 of the hanging member 10, such that the stop column 16 of the hanging member 10 is removed from the receiving hole 24 of the fastening member 20, and the locking block 25 of the fastening member 20 is unlocked from the stop column 16 of the hanging member 10. In such a manner, when the hand tool 30 is pulled down, the locking block 25 of the fastening member 20 is moved freely and retracted into the receiving hole 24 of the fastening member 20, such that the locking block 25 of the fastening member 20 is detached from one of the retaining grooves 32 of the hand tool 30. Thus, the hand tool 30 is removed from the fastening member 20.

Figure 11:
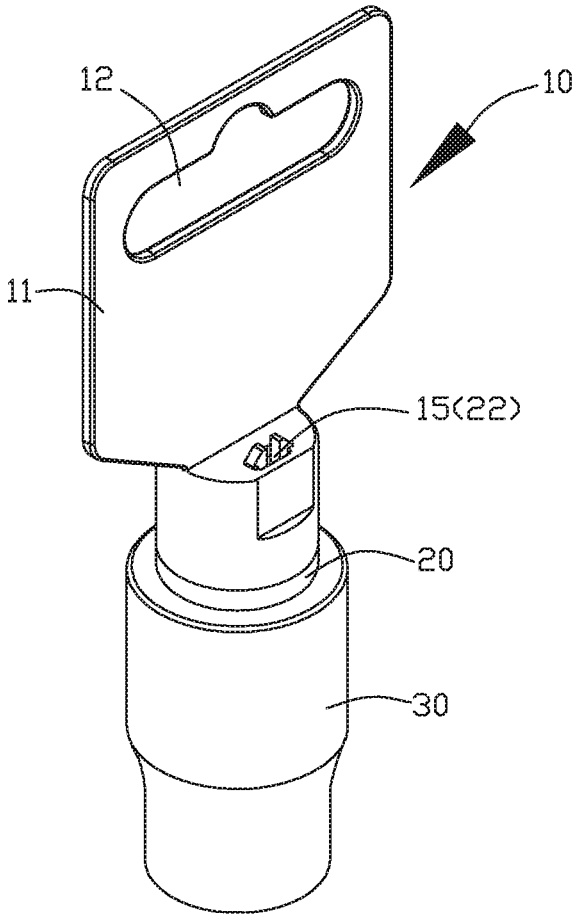
FIG. 11 is a perspective view of an antitheft display pack in accordance with another preferred embodiment of the present invention.

Referring now to FIG. 11, the hand tool 30 is a socket.

Figure 12:
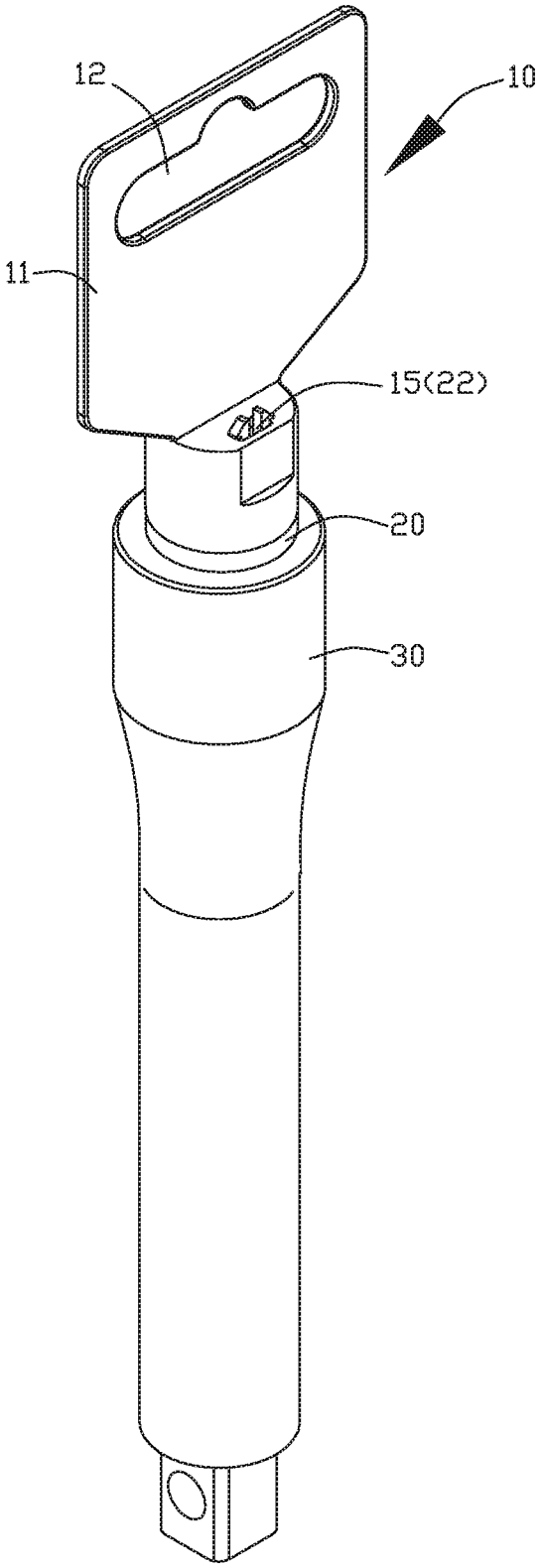
FIG. 12 is a perspective view of an antitheft display pack in accordance with a further preferred embodiment of the present invention.

Referring now to FIG. 12, the hand tool 30 is a socket connector or a socket connecting shank.

Accordingly, the locking block 25 of the fastening member 20 is stopped by the stop column 16 of the hanging member 10, and is positioned in one of the retaining grooves 32 of the hand tool 30, such that the hand tool 30 cannot be removed from the fastening member 20 by an external force, thereby achieving an antitheft function.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. An antitheft display pack comprising:

a hanging member;

a fastening member mounted on the hanging member; and a hand tool mounted on the fastening member;

wherein:

the hanging member includes a main body and a support portion;

the main body of the hanging member is provided with a hanging hole;

the support portion of the hanging member has an interior provided with a mounting chamber;

the support portion of the hanging member has a side provided with at least one locking hole connected to the mounting chamber;

the support portion of the hanging member is provided with a stop column disposed in the mounting chamber;

the fastening member includes a first limit portion and a second limit portion;

the first limit portion of the fastening member is mounted in the mounting chamber of the hanging member;

the first limit portion of the fastening member is provided with at least one locking hook locked in the at least one locking hole of the hanging member;

the fastening member is provided with a receiving hole;

the stop column of the hanging member is mounted in the receiving hole of the fastening member;

the second limit portion of the fastening member has a side provided with a locking block;

the hand tool is provided with a slot mounted on the second limit portion of the fastening member;

the slot of the hand tool has a periphery provided with a plurality of retaining grooves; and the locking block of the fastening member is locked in one of the retaining grooves of the hand tool.

2. The antitheft display pack of claim 1, wherein the mounting chamber of the hanging member has an inner diameter with a non-circular shape, and the first limit portion of the fastening member has a non-circular shape corresponding to that of the mounting chamber, such that the first limit portion of the fastening member is located in the mounting chamber of the hanging member, and is non-rotatable relative to the support portion of the hanging member.

3. The antitheft display pack of claim 1, wherein the at least one locking hole of the hanging member has a number more than two, and the at least one locking hook of the fastening member has a number equal to that of the at least one locking hole.

4. The antitheft display pack of claim 1, wherein the stop column of the hanging member has an outer diameter slightly smaller than an inner diameter of the receiving hole of the fastening member.

5. The antitheft display pack of claim 1, wherein the locking block of the fastening member has a top connected with the second limit portion of the fastening member and has a periphery separated from the second limit portion of the fastening member.

* * * * *